US007450679B2

(12) United States Patent
Georgii

(10) Patent No.: US 7,450,679 B2
(45) Date of Patent: Nov. 11, 2008

(54) CONTAINER DEVICE FOR THE STORAGE OF HAZARDOUS MATERIAL AND METHOD FOR MANUFACTURING IT

(75) Inventor: Hans Georgii, London (GB)

(73) Assignee: Oyster International, N.V. (AN)

( * ) Notice: Subject to any disclaimer, the term of this patent is extended or adjusted under 35 U.S.C. 154(b) by 343 days.

(21) Appl. No.: 10/583,100

(22) PCT Filed: Dec. 30, 2004

(86) PCT No.: PCT/SE2004/002052

§ 371 (c)(1),
(2), (4) Date: Jun. 16, 2006

(87) PCT Pub. No.: WO2005/064619

PCT Pub. Date: Jul. 14, 2005

(65) Prior Publication Data

US 2007/0081621 A1 Apr. 12, 2007

(30) Foreign Application Priority Data

Dec. 30, 2003 (SE) ..... 0303600

(51) Int. Cl.
*G21F 5/00* (2006.01)
*G21F 5/008* (2006.01)
*G21C 19/00* (2006.01)

(52) U.S. Cl. ..... 376/272; 250/506.1; 250/507.1; 250/518.1

(58) Field of Classification Search ..... 376/272; 250/506.1, 507.1, 518.1
See application file for complete search history.

(56) References Cited

U.S. PATENT DOCUMENTS

| | | | | |
|---|---|---|---|---|
| 5,848,111 | A * | 12/1998 | Wells et al. | 376/272 |
| 5,909,475 | A * | 6/1999 | Wells et al. | 376/272 |
| 6,785,355 | B2 | 8/2004 | Georgii | |
| 2005/0201506 | A1 | 9/2005 | Georgii | |
| 2006/0021981 | A1 * | 2/2006 | Georgii | 220/62.15 |
| 2006/0120500 | A1 | 6/2006 | Georgii | |

FOREIGN PATENT DOCUMENTS

WO WO 2004051671 6/2004

OTHER PUBLICATIONS

Okamura et al.: "Self-compacting Concrete", Journal of Advanced Concrete Tech., vol. 1, Apr. 2003, pp. 5-15.

* cited by examiner

*Primary Examiner*—Nikita Wells
(74) *Attorney, Agent, or Firm*—Stites & Harbison PLLC; Douglas E. Jackson

(57) ABSTRACT

Abstract A container device (11) for the long-term storage of hazardous material F), particularly for use for the ultimate disposal of nuclear fuel, comprises a plurality of containment bodies (A, B, C, D), placed successively one with in the other. Each containment body comprises a casing wall and an upper and a lower end wall and has a compartment defined by these walls. The innermost containment body (A) holds the hazardous material and each of the other containment bodies B, C, D) contains a respective next inner containment body (A, B, C). Self-compacting concrete is used to fill the spaces between the containment bodies.

9 Claims, 3 Drawing Sheets

CONTAINER DEVICE FOR THE STORAGE OF HAZARDOUS MATERIAL AND METHOD FOR MANUFACTURING IT

This invention relates to a container device for the long-term storage of hazardous materials. In particular, the type of hazardous material contemplated is nuclear fuel or other radioactive materials that retain a high activity level for very long times and have to be stored in a safe manner at least until the activity has fallen to a level which is not dangerous or which is at least tolerable. For that reason, the invention will be described with particular reference to its application to the ultimate disposal of spent nuclear fuel. However, the applicability of the invention is not limited to any particular type of hazardous material. Other types of hazardous material that may be contemplated are nuclear weapons or parts of such weapons, war gases, extremely hazardous biological materials, etc.

Container devices for the ultimate disposal of nuclear fuel have to meet requirements which are much more stringent in several respects than the requirements which are applicable to shipping containers or other containers for the short-term storage of nuclear fuel. While container devices of the last-mentioned category have to admit of safe storage for periods of time which may be several decades, container devices for the ultimate storage have to be safe for substantially longer periods of time, such us several centuries or even thousands of years. For example, in a current research and development project aiming at creating an ultimate repository in the state of Nevada in the United States, a prerequisite is that the storage of the radioactive material must be safe for tens of thousands of years.

Among the requirements to be met is that which requires the container devices to withstand extreme mechanical loads, both short and long-term static and dynamic loads and chock loads, such as loads that can occur as a result of earthquakes and other seismic movements or in connection with nuclear detonations or other war or terrorist operations. Other requirements to be met are those which call for extremely long-term stability, such as resistance to corrosion or other decomposition or ageing phenomena, even under the influence of heating caused by the contained nuclear fuel, occurring in the materials of the container devices, or at least the material of parts whose failure compromise the safety.

Swedish Patent Application No. 0203528-5 of 29 Nov. 2002 (Applicant Oyster International N.V.), which is equivalent to International Application PCT/SE2003/001837, published as WO 2004/051671 A1, proposes a container device which is suitable for the ultimate disposal of nuclear fuel and enables a satisfactory safe containment of stored nuclear fuels or other kinds of hazardous material for as long time as is required. The above-identified application also proposes a method and installation for manufacturing the container device.

A feature of the container device according to the above-identified patent application which is essential for the achievement of the stated object resides in a kind of box-in-box construction of the finished, sealed container device in which a number of concrete barriers alternate with metal barriers between the hazardous material and the outer side of the container device. Basically, the number of such barriers can be unlimited and selected in accordance with the desired degree of safety. If a barrier should become damaged by force or corrosion or fail for some other reason, other barriers remain to prevent the stored hazardous material from coming out of the container.

The design of the container device as a composite structure provides an interaction between the barriers, which are made alternately from concrete and a different material, preferably metal, that results in a very good mechanical strength.

The present invention is directed to an improvement of a container of the kind disclosed in the above-identified patent application and of the technology for manufacturing it and provides solution to the problem of optimising the container device, especially as regards its manufacture.

The solutions to that problem provided by the present invention are (1), a container device for the long-term storage of hazardous material, especially for the ultimate disposal of nuclear fuel, and (2) a method for manufacturing it. This container device and this manufacturing method have the features which are set forth in the independent claims.

An important element in the present invention is the casting material that is used to fill the cavities in the containment bodies. According to the invention, so-called self-compacting concrete, often abbreviated SCC, sometimes SCC is referred to as high-performance concrete or "cold ceramic") is used as casting material. SCB is concrete or a concrete-like material on which very low viscosity (high flowability) has been conferred by the addition of viscosity modifiers such that it can run out solely by gravity, thus without being vibrated, and easily completely fill casting formwork even in narrow parts thereof (see, for example, Okamura, H., and Ouchi, M.: Self-Compacting Concrete, Journal of Advanced Concrete Technology, Vol. 1, pp 5-15, Apr. 2003). With application of the present invention it is therefore feasible in a technologically simple and economic manner to build a container device according to the box-in-box principle with a number of "boxes" and a corresponding number of different barriers that are required to achieve the desired safe long-term storage capability.

An embodiment of the container device and a method for making it will be described below with reference to the accompanying drawings.

Figure 1:
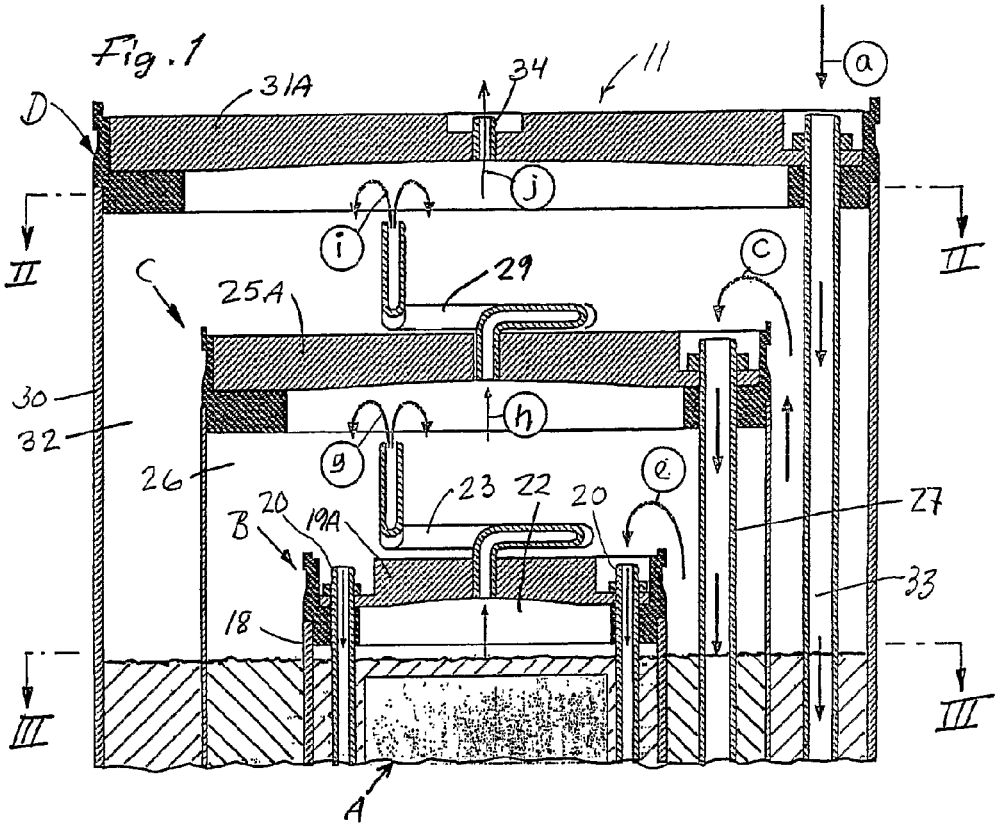
FIG. 1 is a perspective view in vertical section of a completed container device made by the method according to the invention.
Figure 1:
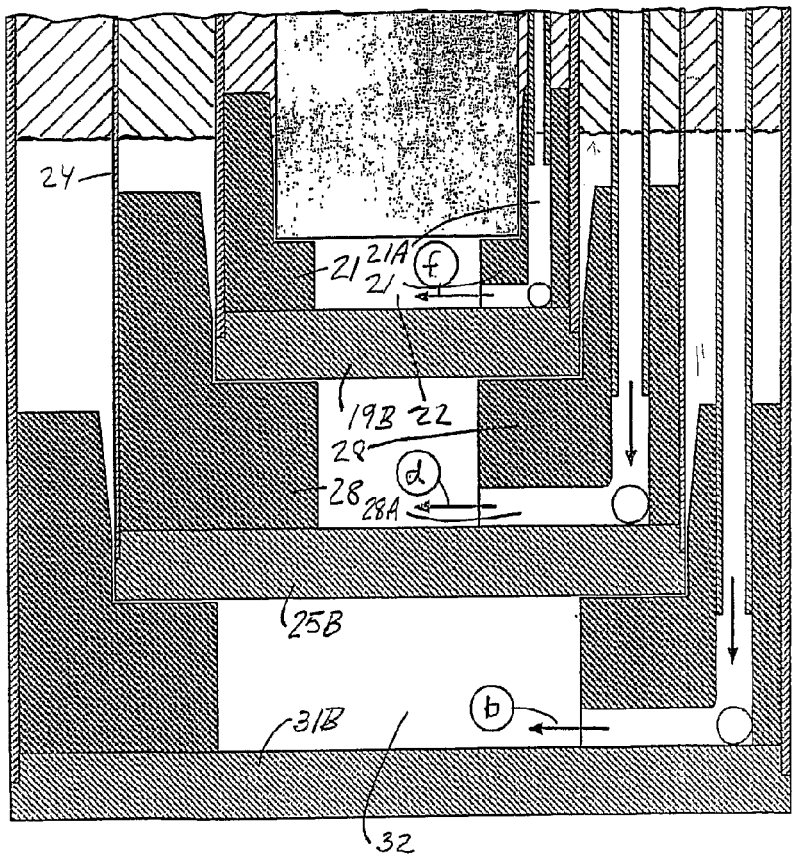
Figure 2:
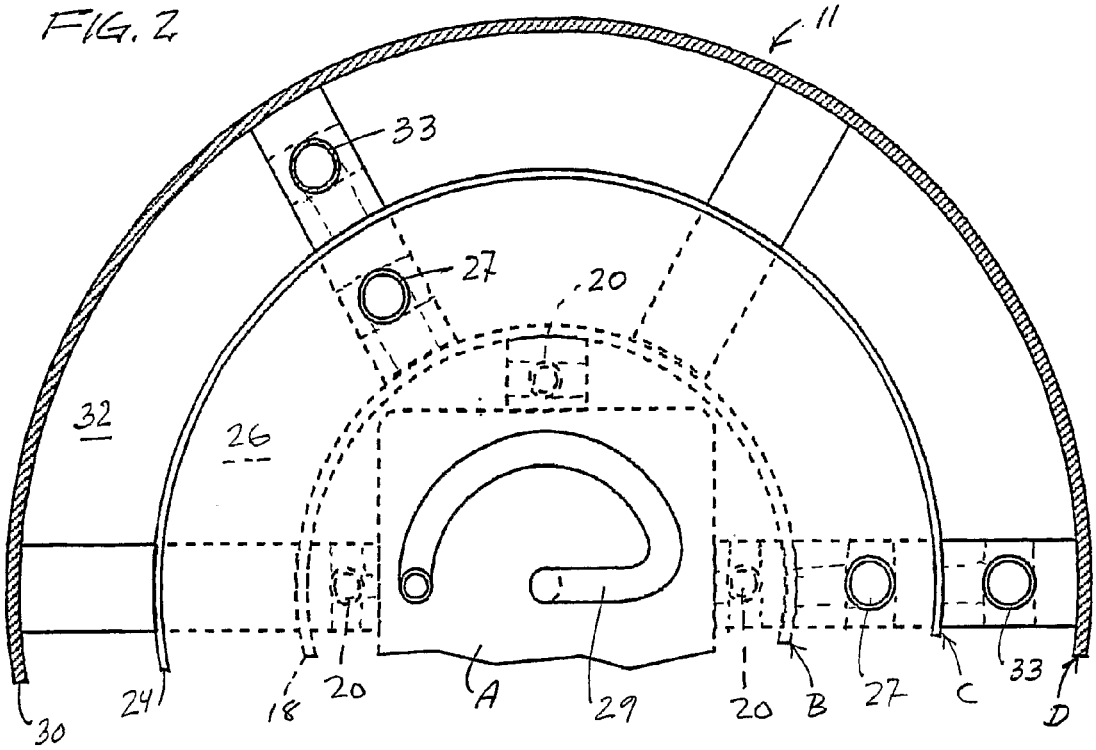
FIG. 2 shows the container device as viewed in section along line II-II in FIG. 1.
Figure 3:
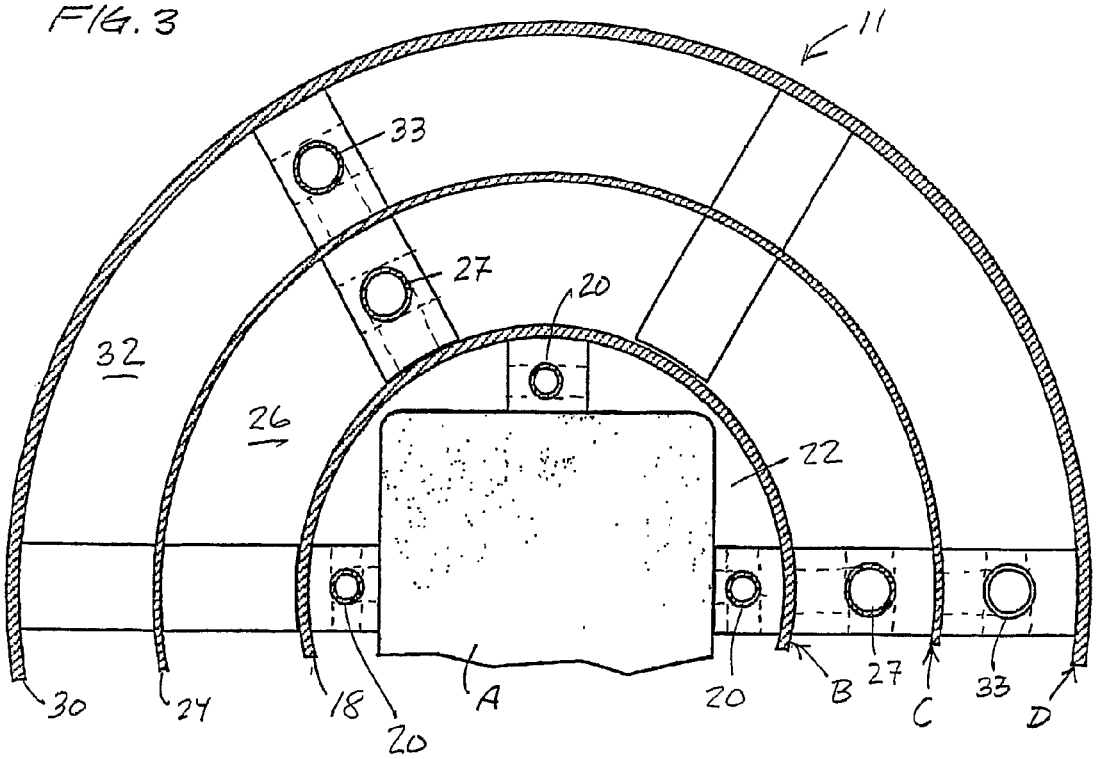
FIG. 3 shows the container device as viewed in section along line III-III in FIG. 2.

The following description, including the drawing figures, of the container device of the invention and of the method and the installation for making it, is limited to what is essential for the understanding of the invention. As is readily appreciated, the implementation of the invention requires subject matter that is not illustrated or described, but the person skilled in the art, guided by the description that follows, can add what is lacking merely by exercising his skill.

Figure 5:
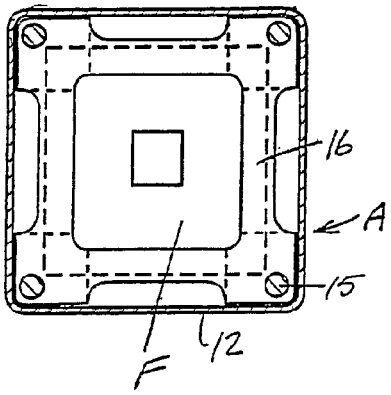
FIG. 5 shows the containment body of FIG. 4 as viewed in cross-section along line V-V.
Figure 4:
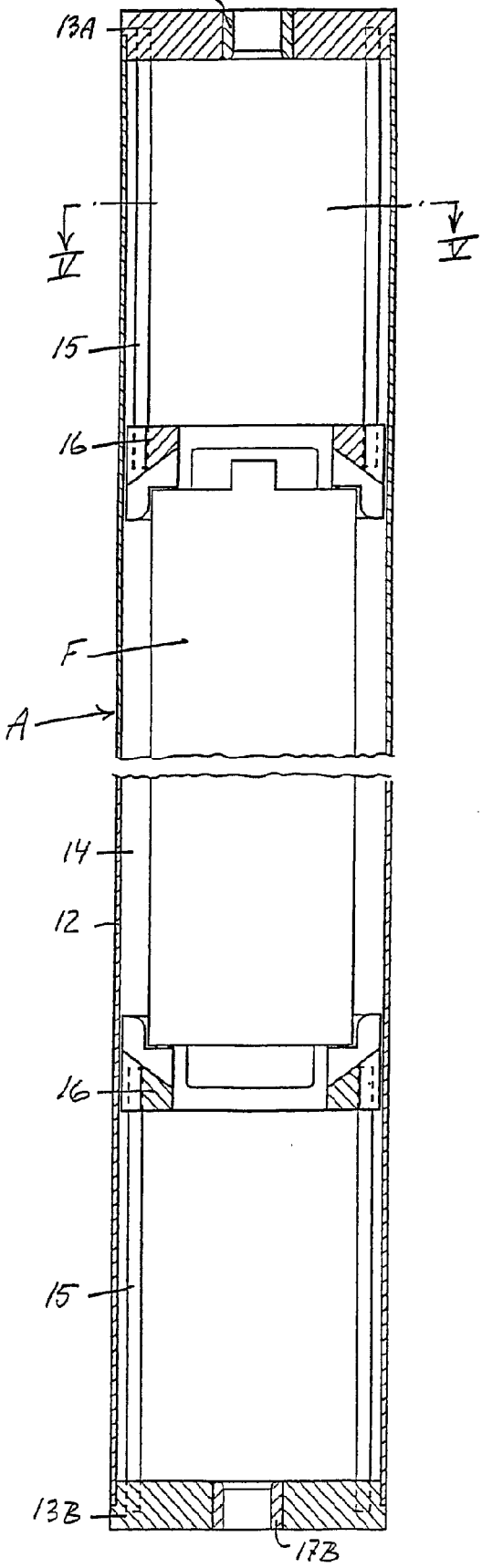
FIG. 4 is an axial sectional view of a first, inner containment body containing a nuclear fuel assembly and forming a central or innermost part of the container device.

The container device 11 illustrated in the drawings is adapted to contain a hazardous-material body F formed by a single nuclear fuel assembly or, alternatively, four similar nuclear-fuel assemblies joined in a "package" for storage purposes. FIGS. 4 and 5 diagrammatically show the hazardous-material body F as formed by a single fuel assembly containing a set of fuel rods (not shown) holding the hazardous material proper, that is the nuclear fuel.

The hazardous-material body F formed by the fuel assembly is contained in a first sub-container or containment body A which is in the shape of an elongate cylindrical body of square cross-section (naturally, the cross-section may alternatively be round or of a different non-square shape) and comprises a casing wall 12 of sheet metal and end walls 13A and 13B formed respectively of an upper metal plate and a lower metal plate. In the compartment 14 formed by the casing wall 12 and the end walls 13A, 13B, rods 15 are secured to each end wall to carry support members 16 at a distance from the end walls. These support members hold between them the hazardous-material body F such that there is an open space between the fuel assembly and the inner side of the casing wall 14 and between the fuel assembly and the end walls 13A, 13B.

Each of the two end walls 13A, 13B has a central opening formed by a sleeve 17A, 17B. These sleeves are schematic representations of means not shown in detail which are used for the introduction of a casting compound—according to the present invention, this casting compound is self compacting concrete—into the open space in the compartment 14 after the hazardous-material body F has been mounted in the compartment. The concrete, which may contain reinforcing fibres, preferably of a heat-conducting material to improve the heat-transmission properties of the concrete, may also be caused to enter through openings in the end and/or the sides of hazardous-material body to fill cavities therein, such as open spaces between fuel rods if the hazardous-material body is a fuel assembly so that the fuel rods will be embedded in the concrete. The aforesaid means for introducing the concrete may, but need not, comprise a valve mounted in one of the end walls of the containment body A through which the concrete is introduced and a valve mounted in the other end wall through which excess concrete is forced out of the containment body A.

In the completed container device 11 the first containment body A is surrounded by a second sub-container or containment body B. This containment body is in the shape of an elongate cylindrical body of circular cross-section and comprises a casing wall 18 of sheet metal and end walls 19A and 19B formed of a lower end plate and an upper end plate, respectively. Slightly inwardly of the casing wall a number of axial tubes 20 extend from the upper end wall 19A to the vicinity of the lower end wall 19B. These tubes serve as passages for supplying the casting material. In addition, the may be used for other purposes, such as to hold the casing wall and the end wall together. Moreover, the may serve as reinforcing members and as attachments for lifting eyes or other fittings to facilitate lifting and transport. Naturally, it is also possible and suitable to provide separate axial reinforcing members, especially between the casing walls 24 and 30 of the containment bodies C and D which are described below.

On each of the end walls 19A, 19B four support members 21 are mounted to retain the containment body A in the compartment 22 defined by the casing wall 18 and the end walls 19A, 19B such that the containment body A is fixed in an axially and radially centred position relative to the second containment body B with a spacing relative to both the casing wall 18 and the end walls 19A, 19B as is best seen in FIG. 1. The lower end portion of each tube 20 is inserted in an associated one of the support members 21, which are provided with passages 21A to form an open connection between the compartment 22 and the interior of the tubes 20.

The space in the compartment 22 which exists between the first containment body A and the second containment body B is considerably larger than the corresponding space between the first containment body A and the hazardous-material body F, and like the latter space it is completely filled with concrete in the finished container device 11. The walls of the hollow cylindrical concrete body that encloses the first containment body A within the completed container device 11 thus are substantially thicker than the walls of the concrete body that encloses the hazardous-material body F in the first containment body A.

The underside of the upper end wall 19A of the containment body B is slightly conically concave, and at the uppermost point of the underside a tube 23 is mounted which communicates with the compartment 22 and extends upwards, opening into the space above the end wall 19A.

The second containment body B is enclosed by a third containment body C which is arranged and constructed in substantially the same manner as the containment body B. Thus, the containment body C comprises a circular cylindrical casing wall 24 and upper and lower end walls 25A, 25B. These end walls define a compartment 26 which houses axial tubes 27 passing downwards through the upper end wall 25A, into the compartment 26 down to the vicinity of the lower end wall 25B and into support members 28. The support members 28 are provided with passages 28A similar to the passages 21A and together with similar support members (not shown) at the upper end wall 25A keep the second containment body B fixed in a well-defined radial and axial position within the compartment 26.

In the completed container device, the space in the compartment 11 which is formed between the second containment body B and the third containment body C is filled with concrete.

Like the underside of the upper end wall of the containment body B, the underside of the upper end wall 25A of the containment body C is slightly conically concave, and at the uppermost point of the underside, a tube 29 is mounted which communicates with the compartment 26 and extends upwards from the end wall 25A, opening into the space above that end wall.

In the illustrated embodiment there is also a fourth containment body D in which the third containment body C is enclosed in a radially and axially centred position and which is substantially identical with the containment body C apart from the dimensions. Accordingly, the containment body D comprises a circular cylindrical casing wall 30 and upper and lower end walls 31A, 31B. These casing and end walls define a compartment 32 which houses axial tubes 33 having the same function as the tubes 27 and extend into support members which are similar to the support members 28. Moreover, at the highest point of the compartment 32 a tube 34 is mounted which may be adapted to be connected to a suction device for a purpose to be described.

In the completed container device 11, the space in the compartment 32 that is formed between the third containment body C and the fourth containment body D is filled with concrete.

As will be appreciated, the drawing figures show the container device according to the invention in simplified form and with omission of many details which form no part of the invention and do not have to be illustrated and described to enable the person skilled in the art to carry out the invention. For example, as a practical matter, the sub-containers or containment bodies A to D have to be provided with auxiliary elements enabling lifting and other manipulation of them, possibly also measuring or monitoring devices etc.

Manufacture of the container device according to the invention may take place in an installation in which the different components of the device are preferably assembled at least partly under water, as in the installation illustrated and described in the above-mentioned patent application and also in the installation illustrated and described in WO01/78084.

Up to the stage in which the containment bodies of the container device are filled with concrete, the containment bodies may be assembled in different ways. In accordance with one procedure, the outermost containment body D with the upper end wall 31A still unmounted is first placed in an underwater position, whereupon the second outermost containment body C, also without the upper end wall, is placed in the outermost containment body D. Similarly, the second innermost containment body, likewise without its upper end wall, is placed in the second outermost containment body C, and, finally, the innermost containment body A is placed in the containment body B, whereupon the hazardous-material body F is placed in the containment body A.

When the above-described steps are completed, the containment bodies A, B, C and D are successively provided with their upper end walls.

Naturally, it is also possible to carry out the above-described assembly of the containment bodies D, C, B and A in an above-water position and then place the assembled containment bodies in an underwater position, whereupon the hazardous-material body F is placed in the containment body A and the upper end walls of the containment bodies are mounted.

A further possibility is to assemble the containment bodies D, C and B in an above-water position, place the hazardous-material body F in the containment body A in an underwater position, and the containment body assembly D+C+B in an underwater position and place the unit formed by the containment body A and the hazardous-material body F therein in the just-mentioned assembly D+C+B and, finally, mount the upper end walls of the containment bodies D, C and B.

Introduction of the casting material, that is, the self-compacting concrete, advantageously takes place in an underwater position with the assembled container device 11 filled with water. The concrete, which as mentioned above can advantageously contain short reinforcing fibres of a heat conducting material, is fed through one or, preferably, several or all of the tubes 33 of the outermost containment body D, if desired under a certain pressure to speed up the introduction. In FIG. 1, the introduction is symbolically indicated by an arrow designated by the lower case letter a in a small circle. Subsequent steps of the introduction of the concrete are similarly indicated by arrows designated by lower case letters in small circles.

The concrete exits from the tube or tubes into the compartment 32 of the outermost containment body D near the bottom of the compartment, arrow b, rises gradually in the compartment 32 until the concrete level reaches the upper side of the second outermost containment body C where it enters the tubes 27, arrow c, flows into the compartment 26 of the containment body C near the bottom thereof, arrow d, and gradually rises in that compartment. When the concrete level reaches the upper side of the second innermost containment body B, the concrete flows into the tubes 20, arrow e, and into the compartment 22 of the containment body C near the bottom thereof, arrow f.

As the concrete gradually rises in the compartment 22 of the containment body B it also rises through the containment body A and its compartment 14 and also through the fuel assembly forming the hazardous-material body F so that the fuel rods in the fuel assembly become embedded in the concrete. When the compartment 22 of the containment body B, and thereby the containment body A and the fuel assembly therein, are completely filled, excess concrete exits from the tube 2, arrow g, to further fill the compartment 26 of the containment body C. Similarly, when the compartment 26 of the containment body C is completely filled, the concrete will enter the tube 29, arrow h, and exit into the compartment 32 of the containment body D, arrow i, to further fill that compartment until it is completely filled and excess concrete starts exiting through the tube 34, arrow j.

All cavities in the container device are now filled with the self-compacting concrete, a portion of which is marked by hatching in the middle part of FIG. 1. During the introduction of the concrete, the concrete gradually dispels the water in the cavities upwards. Reverse flow of the concrete can be prevented by providing one or more of the passages through which the concrete enters and exits the containment bodies with a self-closing valve (not shown).

In the alternative described above in which the hazardous-material body F comprising the nuclear fuel assembly or assemblies is placed in the containment body A before that containment body is placed in the containment body B, it may be expedient first to carry out the pouring of the concrete around the hazardous-material body F in the containment body and allow the concrete to set before the unit consisting of the containment body A and the hazardous-material body F embedded in the concrete is placed in the containment body B.

Introducing the self-compacting concrete as described above, meaning that the concrete follows a tortuous path through the container device, is preferable but not necessary. An alternative would be to introduce the concrete in the compartment 32 of the containment body A as described, so that it enters that compartment through the upper end wall 31 and proceeds downwards in the space defined between the casing wall 30 and the casing wall 24 of the second outermost containment body C but is then is allowed to rise gradually in all containment bodies and the hazardous-material body F simultaneously until the compartment 32 of the containment body D and thereby the entire container device 11 is completely filled and excess concrete starts exiting through the tube 34.

In the final phase of the introduction of the self-compacting concrete, and for some time after the introduction has been completed, until the concrete has hardened suitably, the concrete may be held under a certain overpressure such that the set concrete will be prestressed by the tensioned reinforcing members.

The introduction of the concrete and the dispelling of the water can be augmented by applying suction to the tube 34.

Naturally, the number of containment bodies of the container device may be greater or smaller than the number of containment bodies of the embodiment of the container device described above only by way of example.

In the exemplary embodiment of the container device the innermost containment body A is constructed somewhat differently as compared with the other, surrounding containment bodies B, C and D, but it nevertheless is basically constructed in the same way as these, in that it defines a compartment which contains the hazardous-material body F and is filled with self-compacting concrete that completely embeds the hazardous-material body. This is preferable and especially suitable in the application described, in which the hazardous-material body is one or more nuclear fuel assemblies, but is not an indispensable feature of the invention. Thus, the hazardous material may be held in a container that is not itself filled with concrete embedding the hazardous material it holds but is sealed and placed in a containment body, such as the containment body B and embedded in concrete therein.

The invention claimed is:

1. A container device for the long-term storage of hazardous material, particularly for the ultimate disposal of nuclear fuel, comprising an elongate, cylindrical inner containment body having a casing wall, an upper end wall, a lower end wall, a first compartment defined by the casing wall and the end walls for accommodating at least one hazardous-material body formed by the hazardous material or containing or supporting the hazardous material, particularly a hazardous-material body comprising a bundle of rod-shaped nuclear fuel elements, and support means in the compartment supporting the hazardous-material body centrally in the inner compartment and spaced from the casing wall and the end walls, and a cylindrical outer containment body having a casing wall, an upper end wall and a lower end wall a second cylindrical compartment which is defined by the casing wall and the end walls and within which the inner containment body is supported and spaced from the casing wall and end walls of the outer containment body, wherein a passageway extends through at least one of the end walls of the outer containment body and opens into the second compartment to pass self-compacting concrete into the second compartment, a passageway extends through at least one of the end walls of the inner containment body and opens into the first compartment, the passageway communicating with the second compartment so that self-compacting concrete can flow from the second compartment into the first compartment, and a passageway for discharging excess of self-compacting concrete from the top of the outer compartment is provided in the upper end wall of the outer containment body.

2. A container device according to claim 1 comprising an intermediate containment body having a casing wall, an upper end wall a lower end wall and a third compartment which is defined by this casing wall and these end walls and within which the inner containment body is supported and spaced from the casing and end walls of the intermediate containment body, wherein a passageway extends through at least one of the end walls of the intermediate containment body and opens into the third compartment, the passageway communicating with the second compartment so that self-compacting concrete can flow from the second compartment into the third compartment.

3. A container device according to claim 2 comprising a further inter- mediate containment body having a casing wall, an upper end wall, a lower end wall and a fourth compartment which is de- fined by this casing wall and these end walls and within which the further intermediate containment body is supported and spaced from the casing and end walls of the further intermediate containment body, wherein a further passageway extends through at least one of the end walls of the further intermediate containment body and opens into the fourth compartment, the further passageway communicating with the second compartment so that self-compacting concrete can flow from the second compartment into the fourth compartment.

4. A container device according to claim 1, wherein the pass a extending through at least one of the end walls of the outer containment body comprises a conduit which extends through the upper end wall of the outer containment body and opens into the second compartment in the vicinity of the bottom thereof.

5. A container device according to claims 3, wherein for each of the intermediate containment body and the further intermediate containment body the passageway extending through at least one of the end walls comprises a conduit, which extends through the upper end wall of respectively the intermediate containment body and the further intermediate containment body and opens in respectively the third and the fourth compartment in the vicinity of the bottom thereof, and further comprises an opening which is provided in that upper end wall and opens into respectively the fourth and the second compartment.

6. A method for manufacturing a container device for hazardous material, particularly nuclear fuel elements arranged in at least one bundle, e. g. in one or more fuel assemblies, wherein the a hazardous- material body formed by or containing or supporting the hazardous material, is introduced and fixed in a defined position in an essentially cylindrical container, the length of which is substantially larger than the length of the hazardous-material body, with a spacing provided between side and end walls of the container, and is embedded throughout its length and at its ends in a casting compound, which substantially completely fills the space between the hazardous-material body and the side and end walls of the container and then to set, comprising the steps of placing the hazardous-material body in a cylindrical inner containment body having a casing wall, an upper end wall and a lower end wall a first compartment defined by the casing wall and the end walls, and supporting the hazardous-material body cent- rally in the first compartment and spaced from the casing and end walls thereof, at least one of the end walls having a passage communicating with the first compartment, placing the inner containment body in a cylindrical outer containment body having a casing wall, an upper end wall and a lower end wall and a second compartment which is defined by the casing and end walls of the second containment body, and supporting the first containment body centrally in the second compartment and spaced from the casing and end walls thereof, at least one of the end walls having an inlet and an outlet passage communicating with the second compartment, introducing self-compacting concrete in the second compartment through the inlet passage and causing the self-compacting concrete to fill the first and second compartments completely and allowing excess self-compacting concrete to exit through the outlet passage.

7. A method according to claim 6 wherein the self-compacting concrete is introduced in the second compartment through a conduit opening in the vicinity of the bottom wall of the outer containment body.

8. A method according to claim 6 wherein the inner containment body is placed in an intermediate containment body having a casing wall, an upper end wall, a lower end wall and a third compartment defined by these walls, wherein the intermediate containment body is supported in the outer containment body spaced from the casing and end walls thereof and wherein the self-compacting concrete is caused to pass from the outer containment body into the intermediate containment body to fill it completely.

9. A method according to claim 8 wherein the intermediate containment body is placed in a further intermediate containment body having a casing wall, an upper end wall, a lower end wall and a fourth compartment defined by these walls, wherein the further inter- mediate containment body is supported in the outer containment body spaced from the casing and end walls thereof and wherein the self-compacting concrete is caused to pass from the outer containment body into the further intermediate containment body to fill it completely.

* * * * *